US006908321B1

(12) United States Patent
Lai

(10) Patent No.: US 6,908,321 B1
(45) Date of Patent: Jun. 21, 2005

(54) ALL-IN-ONE CARD CONNECTOR

(75) Inventor: Yaw-Huey Lai, Taipei (TW)

(73) Assignee: Tai-Sol Electronics Co., Ltd., Taipei (TW)

( * ) Notice: Subject to any disclaimer, the term of this patent is extended or adjusted under 35 U.S.C. 154(b) by 0 days.

(21) Appl. No.: 10/872,397

(22) Filed: Jun. 22, 2004

(30) Foreign Application Priority Data

May 25, 2004 (TW) ..... 93207007 U

(51) Int. Cl.[7] ..... H01R 13/44
(52) U.S. Cl. ..... 439/140
(58) Field of Search ..... 439/140, 630, 439/677

(56) References Cited

U.S. PATENT DOCUMENTS 3,953,712 A * 4/1976 Horvath ..... 235/449
6,471,550 B2 * 10/2002 Maiterth et al. ..... 439/631
6,666,724 B1 * 12/2003 Lwee ..... 439/630
6,773,308 B2 * 8/2004 Lwee ..... 439/630

* cited by examiner

*Primary Examiner*—Phuong Dinh
(74) *Attorney, Agent, or Firm*—Bacon & Thomas, PLLC

(57) ABSTRACT

An all-in-one card connector is comprised of a base, two plate-like members, and a plurality of terminals. The base has an opening formed at a front end thereof, two lateral sections formed respectively at bilateral sides of the opening, a concavity formed at one lateral section, a movable guide member mounted in the concavity for upward and downward movement respectively for blocking a large width card and a small width card, and a springy member mounted between the guide member and the base for generating resilience keeping movement of the guide member. The base is mounted closely between the two plate-like members. Each of the terminals is mounted on the plate-like member and extends into the opening to be electrically connected with contact pads of an inserted electronic card.

6 Claims, 8 Drawing Sheets

ALL-IN-ONE CARD CONNECTOR

BACKGROUND OF THE INVENTION

1. Field of the Invention

The present invention relates generally to electronic devices, and more particularly to an all-in-one card connector exclusively for entry of one single electronic card once.

2. Description of the Related Art

There is a conventional all-in-one card connector, such as four-in-one card connector compatible with four electronic memory cards including MS (Memory Stick), SM (Smart Media), MMC (Multi Media Card), and SD (Secure Digital). Due to a gradually popular memory card of XD (eXtreme Digital), a five-in-one card connector compatible with the XD card in addition to the aforementioned four memory cards is presented.

In the design of the conventional all-in-one card connector, spaces for receiving some electronic cards never mutually interfere, e.g. SM card and SD card. In other words, the user can insert the SM and SD cards into the card connector at the same time, but it will not happen that when one card has been inserted into the card connector, another card fails to be inserted into the card connector. However, once two cards are accidentally inserted into the card connector at the same time, it may incur error action or reading error or even malfunction of the whole card connector. Thus, a card connector, which is compatible with multiple types of memory cards and exclusively allows inserting one single card once, is necessary as improvement of the prior art.

SUMMARY OF THE INVENTION

The primary objective of the present invention is to provide an all-in-one card connector, which is compatible with multiple types of memory cards and is to allow inserting only one electronic card rather than multiple cards once.

The foregoing objective of the present invention is attained by the all-in-one card connector, which is comprised of a base, two plate-like members, and a plurality of terminals. The base is laminated and centrally hollow, having an opening formed at a front end thereof, two lateral sections formed respectively at bilateral sides of the opening, a concavity formed at one of the two lateral sections and recessed downwards from a top side of the base, a movable guide member mounted in the concavity for upward and downward movement by an external force, and a springy member mounted between the guide members and the base for generating resilience, which keeps the guide member moving towards a fixed direction. The two plate-like members respectively include a plurality of slots formed thereon. The base is mounted closely between the two plate-like members, and therefore, at least two receiving spaces are defined between base and the two plate-like members. The two receiving spaces communicate with the outside for receiving at least two types of electronic cards. The terminals each have an end mounted on the plate-like member are embedded into a slot, and partially extend into at least one of the receiving spaces to be electrically connected with contact pads of an inserted card. Accordingly, when an electronic card is inserted into the card connector, the guide member allows the entry of the card to be pushed by the card to move towards a direction to further stop entry of another card.

DETAILED DESCRIPTION OF PREFERRED EMBODIMENTS

Figure 1:
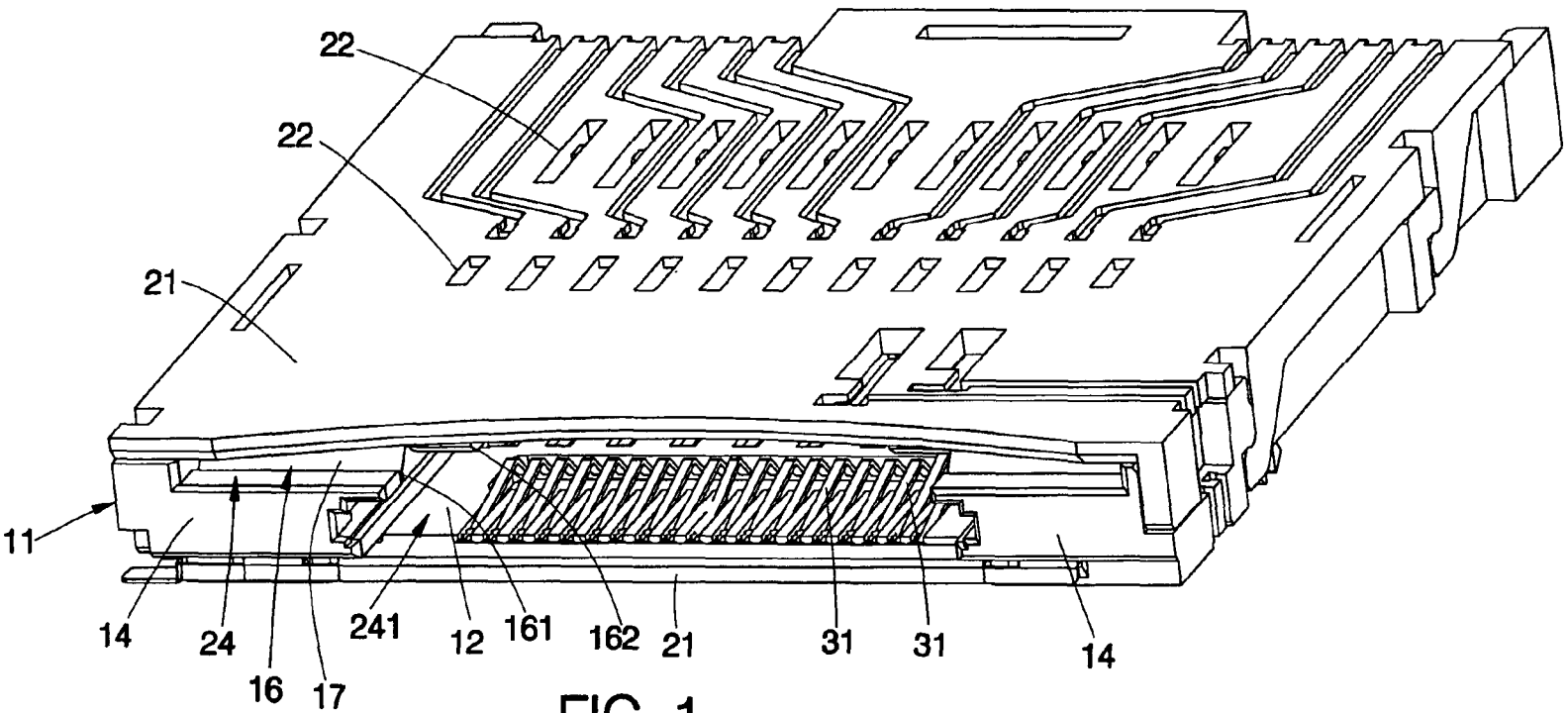
FIG. 1 is a perspective view of a preferred embodiment of the present invention.
Figure 2:
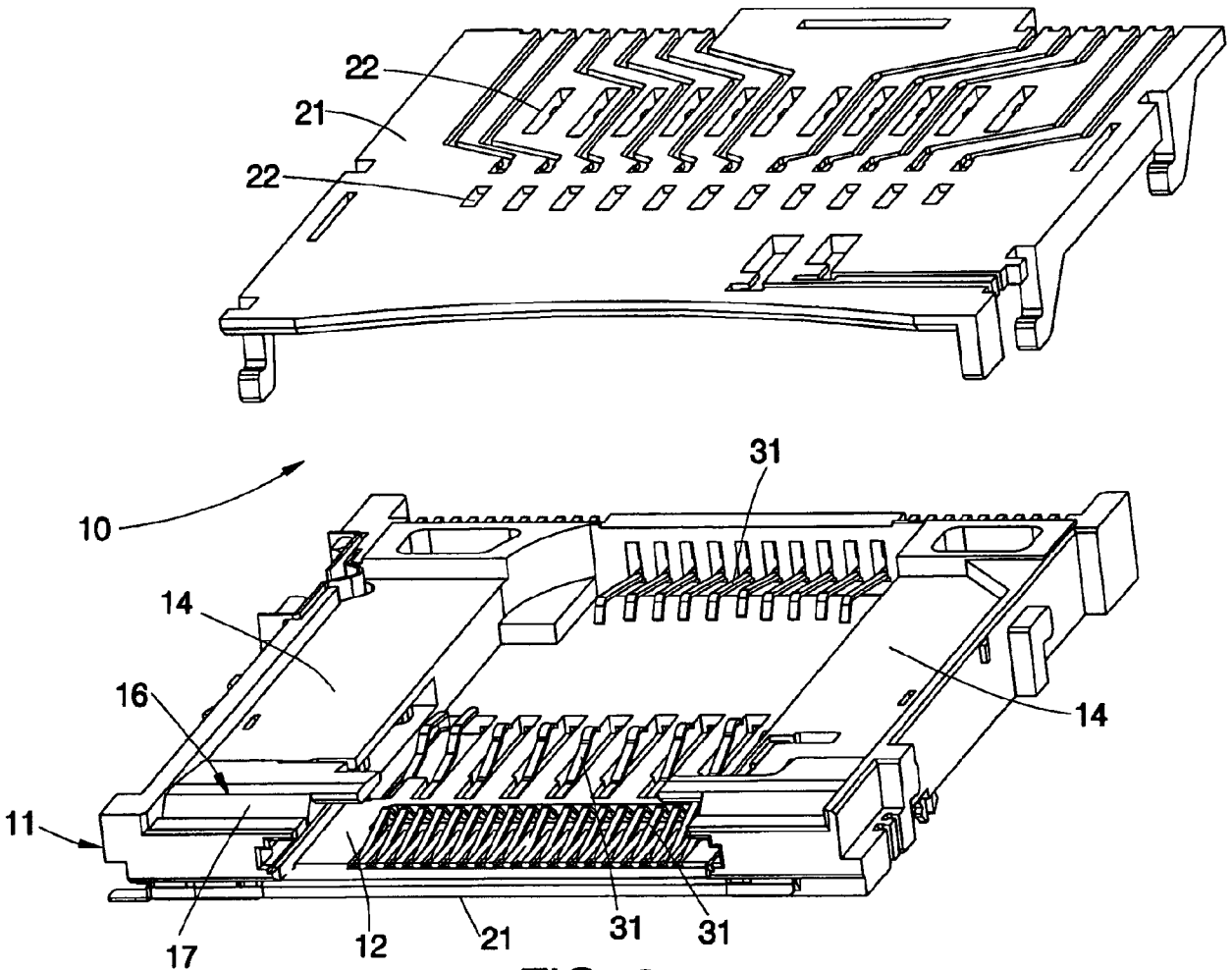
FIG. 2 is an exploded view of the preferred embodiment of the present invention.
Figure 3:
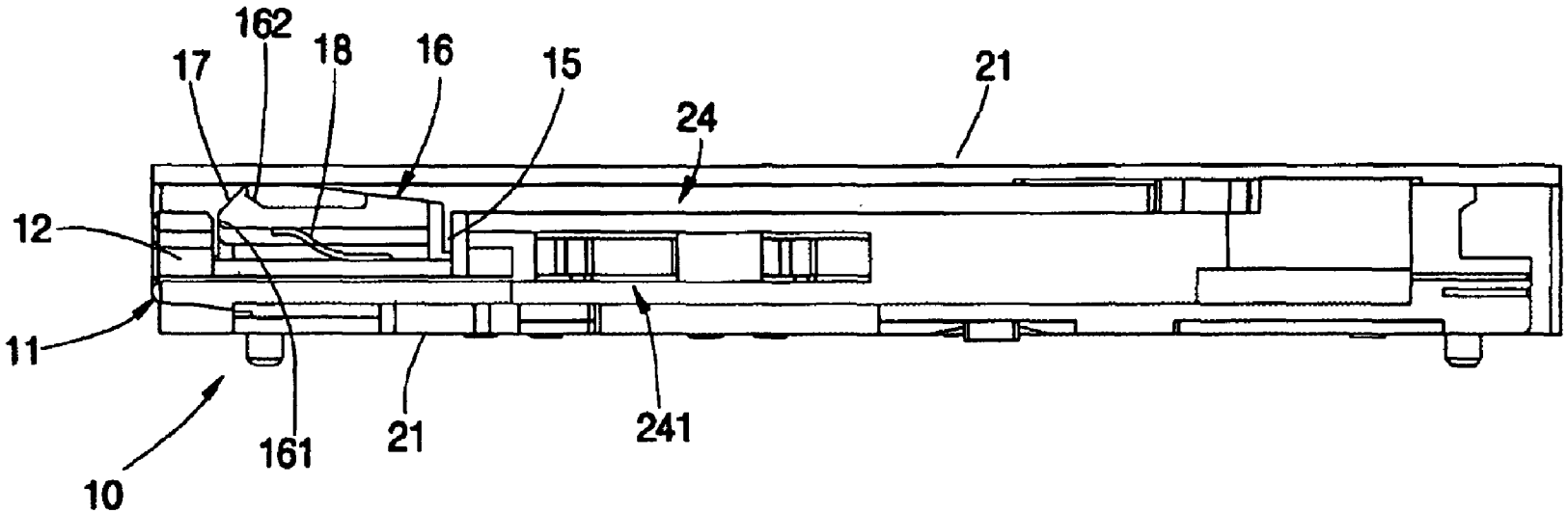
FIG. 3 is a sectional view of the preferred embodiment of the present invention.

Referring to FIGS. 1–3, an all-in-one card connector 10 constructed according to a preferred embodiment is comprised of a laminated base 11, two plate-like members 21, and a plurality of terminals 31.

The base 11 is centrally hollow and is provided with an opening 12 formed at a front end thereof, two lateral sections 14 formed respectively at bilateral sides of the opening 12, a concavity 15 formed at one of the lateral sections 14 and recessed downwards from a top side of the base 11 and abutting the opening 12, a movable guide member 16 mounted in the concavity 15 for upward and downward movement by an external force, and a springy member 18 embodied as a tongue and mounted between a bottom side of the guide member 16 and the base 11 for generating resilience, which keeps the guide member 16 moving upwards. The guide member 16 has a bevel 17 facing forwards and upwards. When an SM card is inserted into the card connector 10, the SM card contacts against the bevel 17 of the guide member 16 and then pushes the guide member 16 downwards. The guide member 16 further has two blocking portions, 161 and 162 respectively, for blocking the SD, MMC, XD, or MS card.

The two plate-like members 21 act as a top plate-like member and a bottom plate-like member respectively including a plurality of slots 22 formed thereon. The base 11 is mounted closely between the two plate-like members 21. At least two receiving spaces 24 and 241 are defined between the base and the two plate-like members 21, communicating with the outside for receiving at least two types of electronic cards.

The terminals 31 each have an end connected with the plate-like member 21, are embedded into the slot 22, and partially extend into at least one of the receiving spaces 24 and 241 to be electrically connected with contact pads of an inserted electronic card (not shown).

Referring to FIG. 3, before an electronic card is inserted into the card connector 10, the guide member 16 is pushed upwards by the springy member 18 to contact against the top plate-like member 21. The two receiving spaces 24, 241 respectively define a first receiving space formed between the top plate-like member 21 and the guide member 16 for receiving the SM card, and a second receiving space 241 formed between the bottom plate-like member 21 and the guide member 16 for receiving the SD, MS, MMC, and XD cards.

Figure 4:
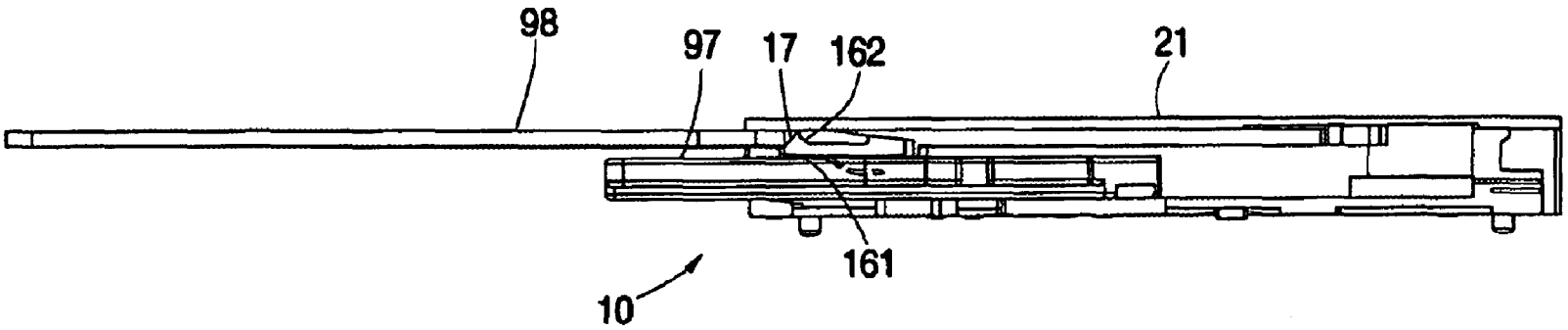
FIG. 4 is a sectional view of the preferred embodiment of the present invention, showing that an SD card is inserted.
Figure 5:
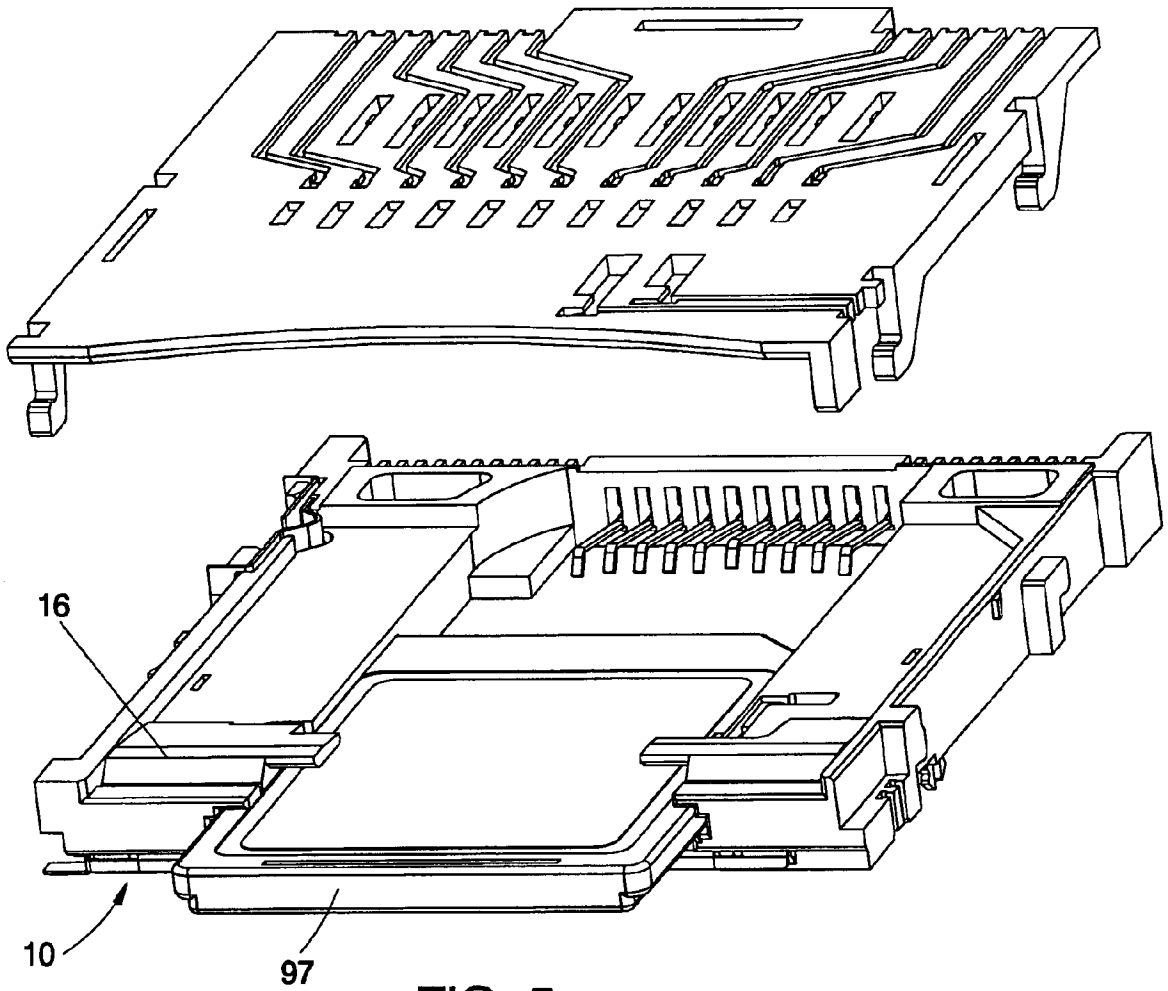
FIG. 5 is a perspective view of the preferred embodiment of the present invention, showing that the SD card is inserted.

Referring to FIGS. 4 and 5, when the SD card 97 is inserted into the card connector 10, the guide member 16 is pushed upwards by the springy member 18 to contact against the top plate-like member 21, such that the SD card 97 can directly pass by the guide member 16 to enter the second receiving space 241. In the meantime, the guide member 16 is located at a higher position, and while inserting the SM card 98 into the card connector 10, the SM card 98 is stopped by the bevel 17 of the guide member 16 and fails to enter the first receiving space 24. It is to be noted that the SD card 97 can alternatively be the MS card, MMC card, or XD card.

Figure 6:
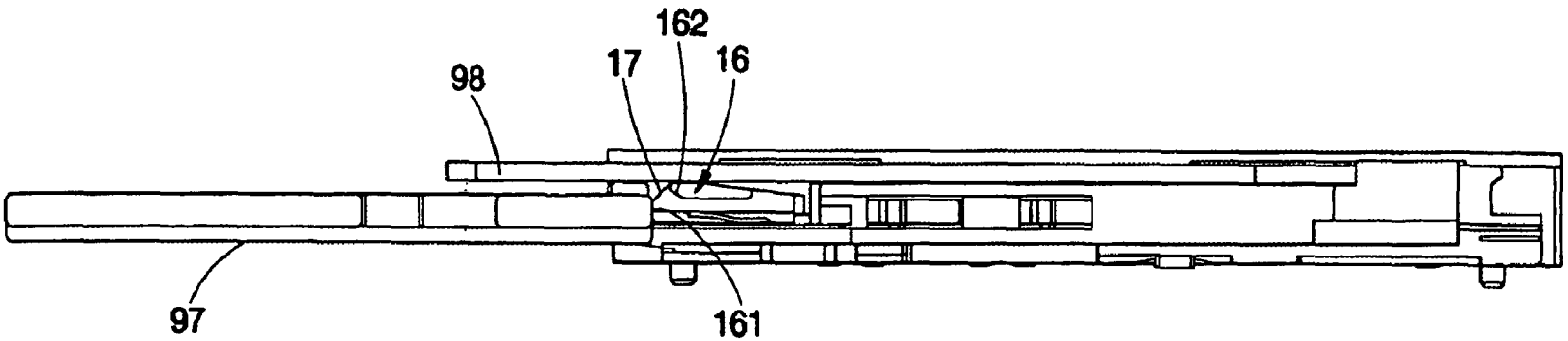
FIG. 6 is a sectional view of the preferred embodiment of the present invention, showing that an SM card is inserted.
Figure 7:
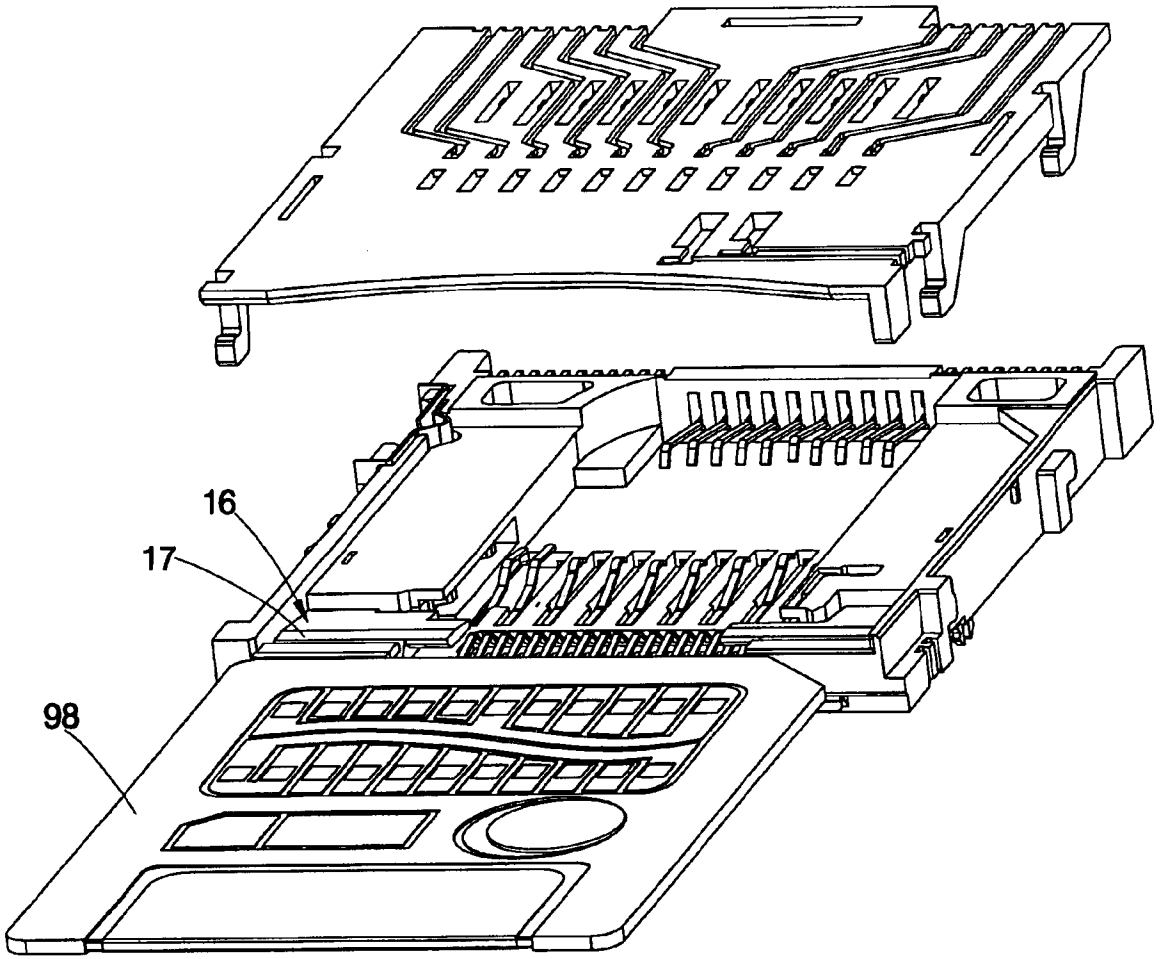
FIG. 7 is a perspective view of the preferred embodiment of the present invention, showing that the SM card is inserted.

Referring to FIGS. 6 and 7, when the SM card is inserted into the card connector, the SM card 98 contacts against the bevel 17 of the guide member 16 and then pushes the guide member 16 downwards to pass by the guide member 16, and meanwhile, the guide member 16 is still being pushed upwards by the springy member 18 to contact against a bottom side of the SM card 98. At the same time, the guide member 16 is located at a lower position, and the SD card 97, MMC card, or XD card is stopped by the blocking portion 161 and fails to enter the second receiving space, and the MS card is stopped by the blocking portion 162 and fails to enter the card connector.

Figure 8:
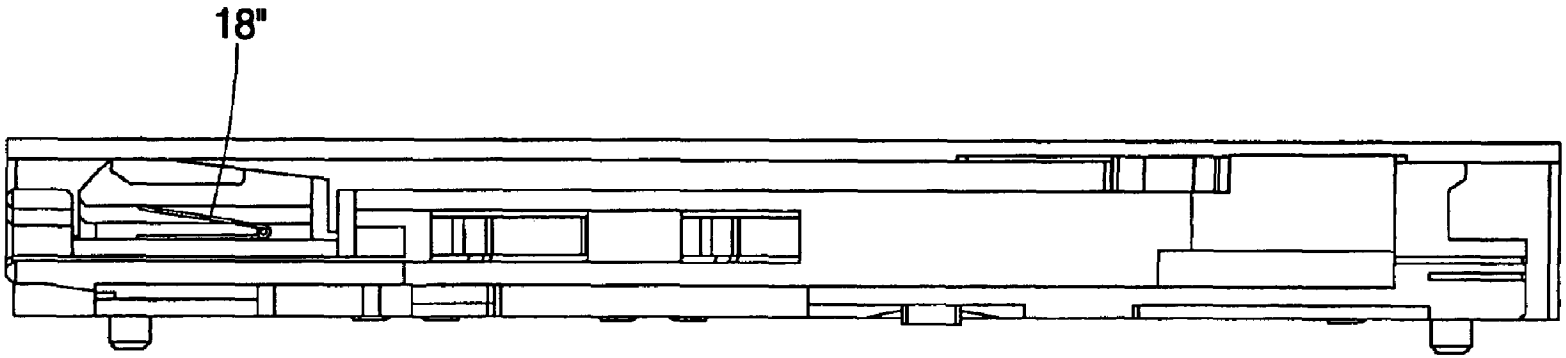
FIG. 8 is a sectional view of the preferred embodiment of the present invention, showing that a springy member is a torsion spring.

Referring to FIG. 8, the springy member 18" can alternatively be a torsion spring to generate the same result as the tongue 18.

From the above recitation, the guide member is indeed to exclusively allow a single electronic card to be inserted into the card connector once and stops the entry of other cards, such that the all-in-one card connector of the present invention is not only compatible with multiple types of electronic cards but also to exclusively allow the entry of one single card once.

It is to be noted that the springy member is not limited to the tongue or the torsion spring and can be other alternative. In addition, the guide member neither structurally thickens the present invention nor alters the external design (locations of pins, shape, thickness, etc.) of the present invention.

What is claimed is:

1. An all-in-one card connector exclusively for entry of one single electronic card once, comprising:

a laminated and centrally hollow base having an opening formed at its front end, two lateral sections formed respectively at bilateral sides of said opening, a concavity formed at one of said lateral sections and recessed downwards from a top side of said base, a movable guide member mounted in said concavity for upward and downward movement by a force, and a springy member mounted between said guide member and said base for generating resilience to maintain movement of said guide member towards a fixed direction;

two plate-like members each having a plurality of slots, said base being closely mounted between said two plate-like members, wherein at least two receiving spaces in communication with outside the connector are defined between said base and said two plate-like members for receiving at least two electronic cards; and a plurality of terminals each having an end mounted on each of said two plate-like members, each of said terminals being embedded to said slot of said plate-like member, and each extending into at least one of said receiving spaces to be electrically connected with contact pads of an inserted electronic card;

wherein said guide member includes a plurality of blocking portions, said plurality of blocking portions including a first blocking portion for blocking insertion of a first predetermined electronic card while allowing insertion of a second predetermined electronic card, and a second blocking portion for blocking insertion of the second predetermined electronic card while allowing insertion of the first predetermined electronic card.

2. The all-in-one card connector as defined in claim 1, wherein said concavity abuts said opening of said base.

3. The all-in-one card connector as defined in claim 1, wherein said guide member includes a bevel facing forwards.

4. The all-in-one card connector as defined in claim 1, wherein said springy member is a tongue.

5. The all-in-one card connector as defined in claim 1, wherein said springy member is a torsion spring.

6. The all-in-one card connector as defined in claim 1, wherein said springy member is located at a bottom side of said guide member for generating resilience to maintain upward movement of said guide member.

* * * * *